US006476724B1

(12) United States Patent
Slomowitz et al.

(10) Patent No.: US 6,476,724 B1
(45) **Date of Patent: *Nov. 5, 2002**

(54) CRIB GATE POSITION INDICATOR

(76) Inventors: Cynthia J. Slomowitz, 33 Maple La., Glen Mills, PA (US) 19342; Scott M. Slomowitz, 33 Maple La., Glen Mills, PA (US) 19342

( * ) Notice: Subject to any disclaimer, the term of this patent is extended or adjusted under 35 U.S.C. 154(b) by 20 days.

This patent is subject to a terminal disclaimer.

(21) Appl. No.: 09/843,976

(22) Filed: Apr. 27, 2001

Related U.S. Application Data

(63) Continuation-in-part of application No. 09/383,176, filed on Aug. 25, 1999, now Pat. No. 6,225,913.

(51) Int. Cl.[7] ..... G08B 21/00
(52) U.S. Cl. ..... 340/686.1; 340/539; 340/573.1
(58) Field of Search ..... 340/539, 686.1, 340/573.1, 573.4, 521, 384.1, 384.7; 381/56, 110

(56) References Cited

U.S. PATENT DOCUMENTS

| | | | |
|---|---|---|---|
| 2,734,104 | A | 2/1956 | Gollhofer |
| 3,641,540 | A | 2/1972 | Cutler et al. |
| 3,833,895 | A | 9/1974 | Fecteau |
| 3,938,121 | A | 2/1976 | Jamison |
| 4,231,030 | A | 10/1980 | Weiss |
| 4,278,968 | A | 7/1981 | Arnett et al. |
| 4,924,214 | A | 5/1990 | Hill |
| 4,951,032 | A | 8/1990 | Langsam |
| 5,057,819 | A | 10/1991 | Valenti |
| 5,210,532 | A | 5/1993 | Knoedler et al. |
| 5,291,181 | A | 3/1994 | DePonte |
| 5,365,214 | A | 11/1994 | Angott et al. |
| 5,402,105 | A | 3/1995 | Doyle et al. |
| 5,499,014 | A | 3/1996 | Greenwaldt |
| 5,512,880 | A | 4/1996 | Abrams et al. |
| 5,604,478 | A | 2/1997 | Grady et al. |
| 5,629,683 | A | 5/1997 | Slomowitz et al. |
| 5,689,236 | A | 11/1997 | Kister |
| 5,748,074 | A | 5/1998 | Chomet |
| 5,757,274 | A | 5/1998 | Slomowitz et al. |
| 5,883,579 | A | 3/1999 | Schreiner et al. |
| 5,973,591 | A | 10/1999 | Schwartz et al. |

OTHER PUBLICATIONS

New Study on how to avoid crib injuries to infants and toddlers—M.V. Ridenour, Ph.D., Temple, College of Education.

*Primary Examiner*—Van Trieu
(74) *Attorney, Agent, or Firm*—Caesar, Rivise, Bernstein, Cohen & Pokotilow, Ltd.

(57) ABSTRACT

A crib gate position indicator for use with a baby crib to automatically alert the parent or infant-caretaker, who is at a location outside of the room or location of the baby crib, when the crib gate has been left in an open condition. The apparatus uses a first combined gate sensor/baby unit for detecting both the sounds of the baby as well as the open condition of the crib gate and then wirelessly transmits a signal, or signals, indicative thereof. A second, remotely-located unit, namely, a combined indicator/parent unit receives the signal, or signals, and plays out the baby sounds as well as providing an indication (visual, audible or tactile) to the parent or caregiver of the open condition of the crib gate.

23 Claims, 10 Drawing Sheets

2180A

1180A

1180B

CRIB GATE POSITION INDICATOR

RELATED APPLICATIONS

This application is a Continuation-in-Part of application Ser. No. 09/383,176 filed Aug. 25, 1999, now U.S. Pat. No. 6,225,913 entitled CRIB GATE POSITION INDICATOR and whose entire disclosure is incorporated by reference herein.

FIELD OF THE INVENTION

This invention relates generally to indicators and, more particularly, to electronic position indicators for the gate of a crib.

BACKGROUND OF THE INVENTION

Most baby cribs comprise a mattress located within a bed frame having four sides, with each side comprising vertical bars positioned between a top molding and a bottom molding. Two opposing sides are vertically displaceable, known as a crib gate, in either a raised (closed) condition or in a lowered (open) position. Lowering the gate is accomplished by displacing a footbar (located at the bottom and just under the bottom molding) which disengages a bottom molding catch from the footbar and then allows the gate to drop downward. Raising the gate is accomplished by simply lifting the gate upwards until the bottom molding catch re-engages the footbar, thereby locking the gate in a raised position.

In most instances, the parent or infant-caretaker will be holding or rocking the baby to sleep. When the parent or infant-caretaker is ready to place the baby on the mattress, the gate is lowered as discussed previously. Usually, the parent or infant caretaker is so focused on positioning the infant on the mattress without waking the infant that frequently the parent or infant-caretaker forgets to raise the gate after the infant is placed on the mattress. The result is that the infant is left in a crib with the gate down. If the infant is old enough to roll and raise himself/herself, the infant could fall out of the crib at a later time because the crib gate remains in an open condition.

Moreover, a recent study conducted by a Temple University researcher has recommended increasing the side heights of cribs to reduce the number of falls from cribs. If this recommendation is followed, the opening and closing of the crib gate by the parent/caregiver should occur more often since raising the height of the crib sides makes it more difficult to place or lift a toddler from the crib without opening the gate. As a result, this increases the chances that a parent/caregiver may walk away from a crib with the toddler inside and with the crib gate left open.

The following U.S. patents disclose some form of indication or warning in association with a baby crib or bed.

U.S. Pat. No. 2,734,104 (Gollhofer) discloses an alarm for alerting an attendant that the crib gate is in a down position.

U.S. Pat. No. 4,231,030 (Weiss) discloses a safety device for a crib that provides an indicating light or an alarm at the crib to alert a person to the fact that the crib gate is in a down position.

U.S. Pat. No. 4,951,032 (Langsam) discloses a crib rail safety monitor that utilizes a weight sensor for detecting the presence of a child in the crib and an ultrasonic motion detector or infrared temperature sensor for detecting the presence of an attendant at the crib in order to provide an indication or alarm at the crib that the crib gate is down when the child is in the crib and is unattended.

U.S. Pat. No. 5,057,819 (Valenti) discloses a safety cushion device that is positioned on the floor adjacent the baby crib for cushioning the fall of a child and an alarm for alerting an adult of such a fall.

U.S. Pat. No. 5,291,181 (DePonte) discloses a wet bed alarm and temperature monitoring system for detecting urine on the bed and the temperature of a person lying on the bed and for supplying a remote annunciator panel with such information.

U.S. Pat. No. 5,629,683 (Slomowitz et al.), whose entire disclosure is incorporated by reference herein, discloses an automatic crib gate indicator that utilizes a remote-enabling means to enable a crib gate sensor that detects the open condition of the crib gate and then transmits a signal to a remotely located indicator.

U.S. Pat. No. 5,757,274 (Slomowitz et al.), whose entire disclosure is incorporated by reference herein, discloses an automatic crib gate indicator that utilizes a crib gate sensor, for detecting the open condition of the crib gate, that is integrated with a baby monitoring system.

However, there remains a need to provide the parent or infant-caretaker with an automatic remotely-located indication or warning of the crib gate being left in open condition while providing a baby monitoring system function and while using the same number of baby monitoring system devices.

SUMMARY OF THE INVENTION

An apparatus for providing an automatic crib gate position indication of a crib having a gate that can be positioned in an open or a closed condition. The apparatus comprises: a non-intrusive unit that is positioned out of reach of an infant or toddler who is placed in the crib and wherein the non-intrusive unit comprises: a first power source; a microphone and transmitter, coupled to the power source, for detecting the sounds of the infant or toddler placed in the crib and for generating a wireless signal representative of the sounds; a switch interfaced with the gate and electrically coupled to a signal generator and whereby the switch electrically couples the signal generator to the power source whenever the gate is in an open condition to form a crib gate open condition signal; and wherein the signal generator has an output coupled to the transmitter for incorporating the crib gate open condition signal into the wireless signal; and further includes: a remotely-located unit, being coupled to a second power source, whereby the remotely-located unit comprises: a receiver, electrically coupled to the second power source, for receiving the wireless signal; a speaker, electrically coupled to the receiver, and whereby the speaker plays out the sounds of the infant or toddler in accordance with the received wireless signal; and an indicator electrically coupled to the receiver wherein the indicator is active whenever the crib gate open condition signal is present in the wireless signal such that the active indicator alerts someone in the vicinity of the remotely-located unit that the crib gate is in an open condition.

An apparatus for providing an automatic crib gate position indication of a crib having a gate that can be positioned in an open or a closed condition. The apparatus comprises: a non-intrusive unit that is positioned out of reach of an infant or toddler who is placed in the crib and wherein the non-intrusive unit comprises: a first power source; a microphone and transmitter that are coupled to the power source and for detecting the sounds of the infant or toddler placed in the crib and for generating a wireless signal representative of the sounds; a switch interfaced with the gate and electrically coupled to a signal generator and wherein the switch electrically couples the signal generator to the power source whenever the gate is in an open condition to form a crib gate open condition signal; and wherein the signal generator has an output coupled to the transmitter for incorporating the crib gate open condition signal into the wireless signal; a remotely-located unit which is coupled to a second power source and wherein the remotely-located unit comprises: a receiver, electrically coupled to the second power source, for receiving the wireless signal; and a speaker, electrically coupled to the receiver wherein the speaker plays out the sounds of the infant or toddler along with any audible variation caused by the presence of the crib gate open condition signal in the received wireless signal wherein the audible variation alerts someone in the vicinity of the remotely-located unit that the crib gate is in an open condition.

An apparatus for providing an automatic crib gate position indication of a crib having a gate that can be positioned in an open or a closed condition. The apparatus comprises: a non-intrusive unit that is positioned out of reach of an infant or toddler who is placed in the crib and wherein the non-intrusive unit comprises a first power source; a microphone and transmitter, coupled to the power source, for detecting the sounds of the infant or toddler placed in the crib and for generating a first wireless signal representative of the sounds; a switch interfaced with the gate and electrically coupled to a second transmitter and whereby the switch electrically couples the second transmitter to the power source whenever the gate is in an open condition to form a second wireless signal representative of the open condition of the crib gate; a remotely-located unit, being coupled to a second power source and wherein the remotely-located unit comprises: a first receiver, electrically coupled to the second power source, for receiving the first wireless signal; a speaker, electrically coupled to the first receiver and wherein the speaker plays out the sounds of the infant or toddler in accordance with the received first wireless signal; and an indicator electrically coupled to a second receiver wherein the indicator is active whenever the second wireless signal is received by the second receiver such that the active indicator alerts someone in the vicinity of the remotely-located unit that the crib gate is in an open condition.

An apparatus for providing an automatic crib gate position indication of a crib having a gate that can be positioned in an open or a closed condition. The apparatus comprises: a non-intrusive gate sensor that is positioned out of reach of an infant or toddler who is placed in the crib and wherein the gate sensor comprises: a power source; a transmitter for wirelessly transmitting a signal when it is electrically coupled to the power source; and a switch interfaced with the gate and which electrically couples the power source to the transmitter whenever the gate is an or open condition; and a remotely-located indicator comprising a receiver and an indicator whereby the receiver receives the signal and activates the indicator to alert a person in the vicinity of the remotely-located indicator that the crib gate is in an open condition.

DESCRIPTION OF THE DRAWINGS

Many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
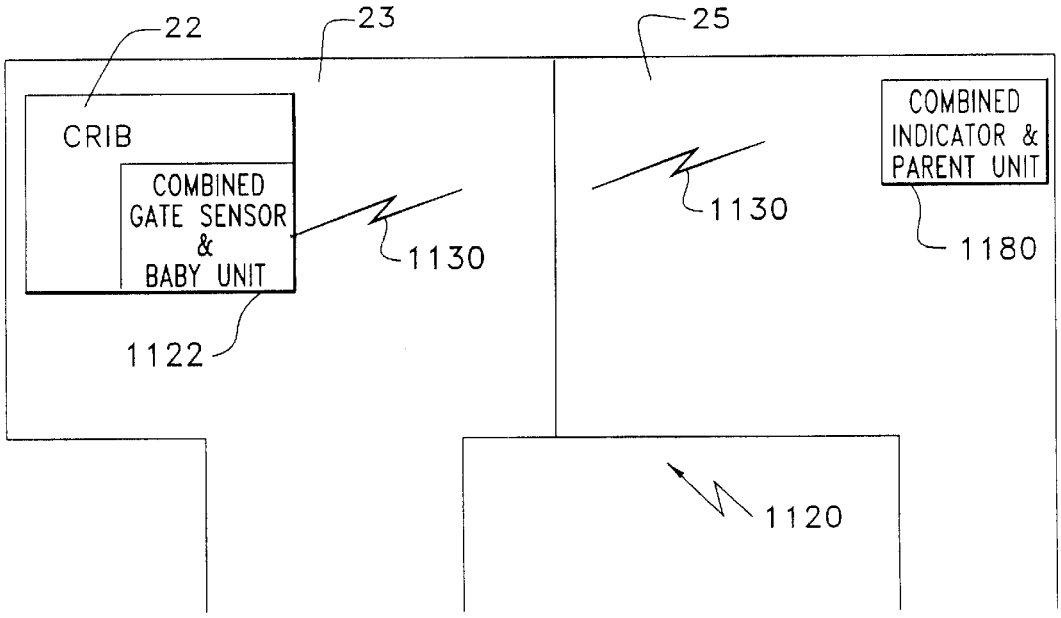
FIG. 1 is a top plan view of a home showing the location of the present invention.

Referring now in greater detail to the various figures of the drawing wherein like reference characters refer to like parts, there is shown generally at 1120 in FIG. 1, a crib gate position indicator constructed in accordance with this invention.

The crib gate position indicator 1120 forms a portion of a baby monitoring system. It should be understood that it is within the broadest scope of this invention to include any type of baby monitoring system, both audio or visual or any combination of the two. Whichever baby monitoring system is used, the common features of these systems are that they include (1) a unit for detecting the sounds of, and/or the image of, the baby and his/her immediate surroundings and then transmitting a wireless signal corresponding thereto, hereinafter referred to as the "baby unit"; and (2) a remotely-located receiver for receiving the transmitted signal that permits the listening to the sounds of, and/or the watching of, the baby and his/her immediate surroundings, hereinafter referred to as the "parent unit." In the present application, the invention is described in terms of an audio-type baby monitoring system for listening to the sounds of the baby. But it should be remembered that the present invention is not limited to such a baby monitoring system and includes all other types.

Figure 2:
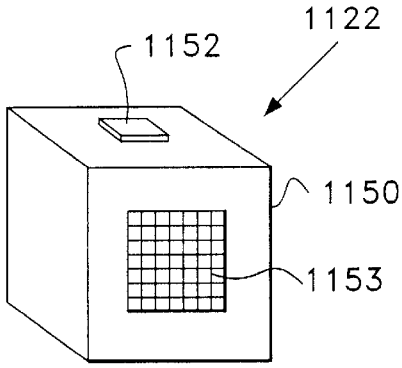
FIG. 2 is an enlarged isometric view of the combined gate sensor/baby unit shown in FIG. 1.
Figure 3:
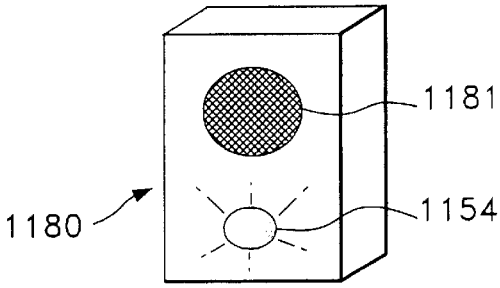
FIG. 3 is an isometric view of the remotely-located, combined indicator/parent unit.
Figure 4:
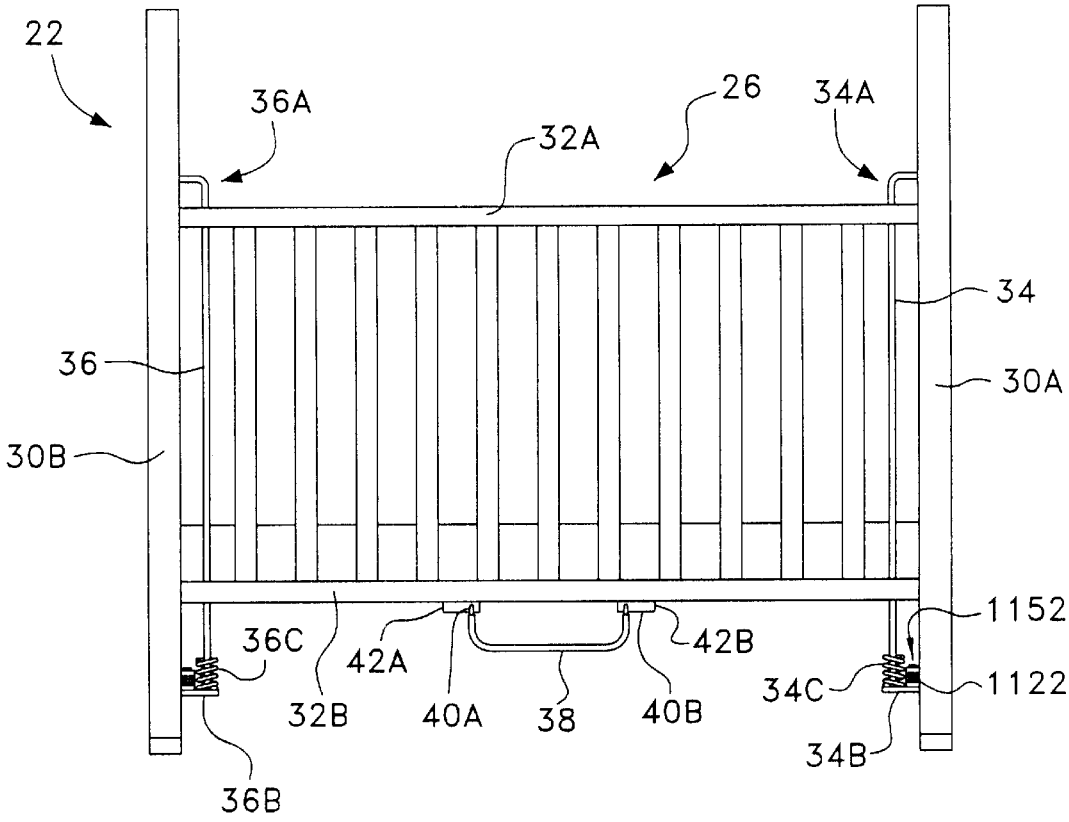
FIG. 4 is a side view of the crib with the combined gate sensor/baby unit coupled thereto.

The crib gate position indicator 1120 comprises a combined gate sensor/baby unit 1122 (FIG. 2) and a remotely-located, combined indicator/parent unit 1180 (FIG. 3). The combined gate sensor/baby unit 1122 is coupled to a conventional baby crib 22 having a crib gate 26 (FIG. 4). Operation of the exemplary crib 22 is discussed in U.S. Pat. No. 5,629,683 (Slomowitz et al.), whose entire disclosure is incorporated by reference herein, and is therefore not repeated here. The remotely-located, combined indicator/parent unit 1180 is located in another room 25, e.g., the parent's bedroom, not necessarily adjacent the baby's room 23. Thus, the crib gate position indicator 1120 provides for the remote indication (i.e., outside of the baby's room 23) of the open position of the crib gate 26.

It should be understood that the present invention 1120 is an improvement of the inventions disclosed in U.S. Pat. No. 5,757,274 (Slomowitz et al.) in that, among other things, the present invention 1120 reduces the number of active electronic units to two, i.e., the devices of U.S. Pat. No. 5,757,274 (Slomowitz et al.) require a gate sensor, a baby unit and a parent unit whereas the present invention requires only the combined gate sensor/baby unit 1122 and the combined indicator/parent unit 1180.

As will be discussed in detail later, the combined gate sensor/baby unit 1122 basically comprises a switch 1152 for detecting the open condition of the gate 26 and a sound sensor 1153 (e.g., microphone, or any equivalent device that converts sound into electrical signals) for detecting the sounds of the baby. The combined gate sensor/baby unit 1122 then generates the wireless signal 1130 which is received by the combined indicator/parent unit 1180. Furthermore, the combined indicator/parent unit 1180 basically comprises an indicator 1154 (either visual or audible) for alerting the parent or caregiver of the open condition of the gate 26 and a sound transducer 1181 (e.g., a speaker, or any equivalent device that converts electrical signals to sound) for providing the sounds of the baby in the crib 22 to the parent or caregiver. Upon receipt of the signal 1130, the combined indicator/parent unit 1180 operates the indicator 1154 and the speaker 1181 accordingly, as will be discussed in detail below.

Figure 5A:
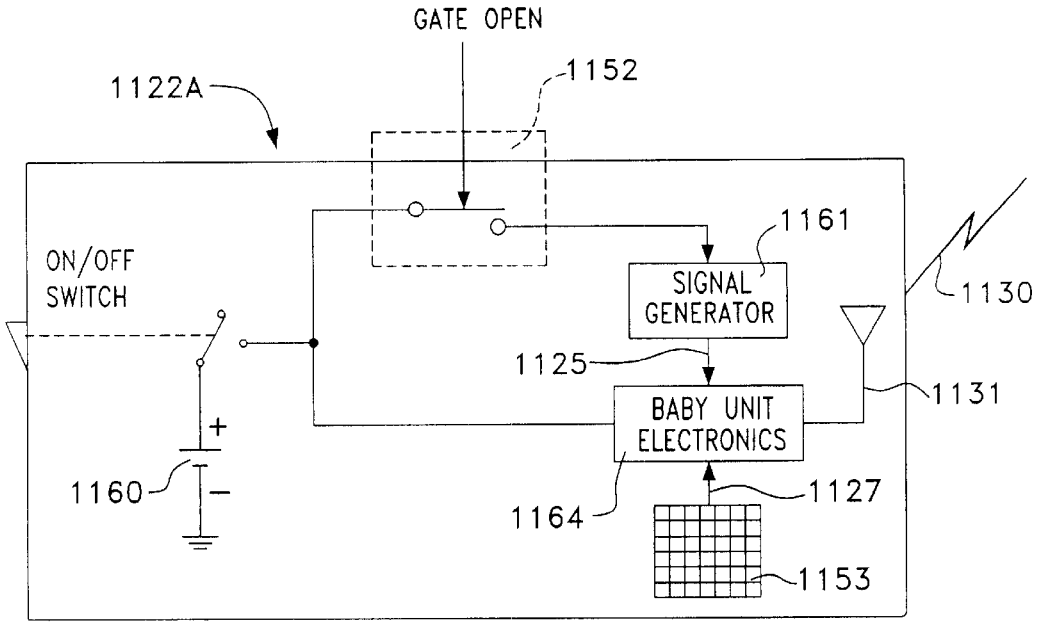
FIG. 5A is a block diagram/schematic of a first embodiment of the combined gate sensor/baby unit.
Figure 5B:
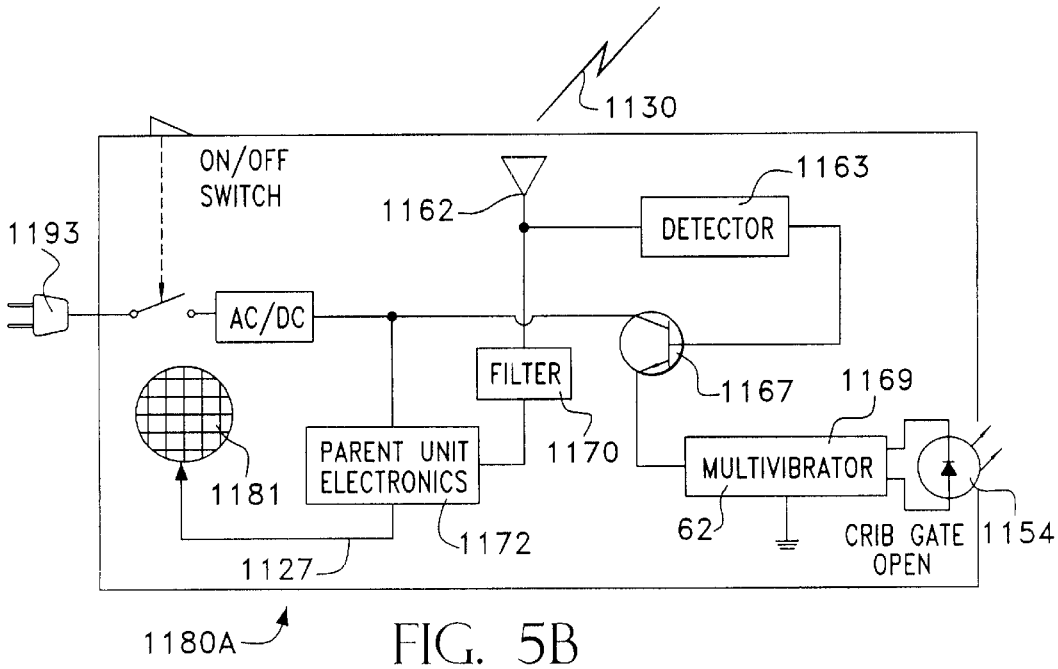
FIG. 5B is a block diagram/schematic of a remotely-located, combined indicator/parent unit that corresponds to the combined gate sensor/baby unit of FIG. 5A.
Figure 5C:
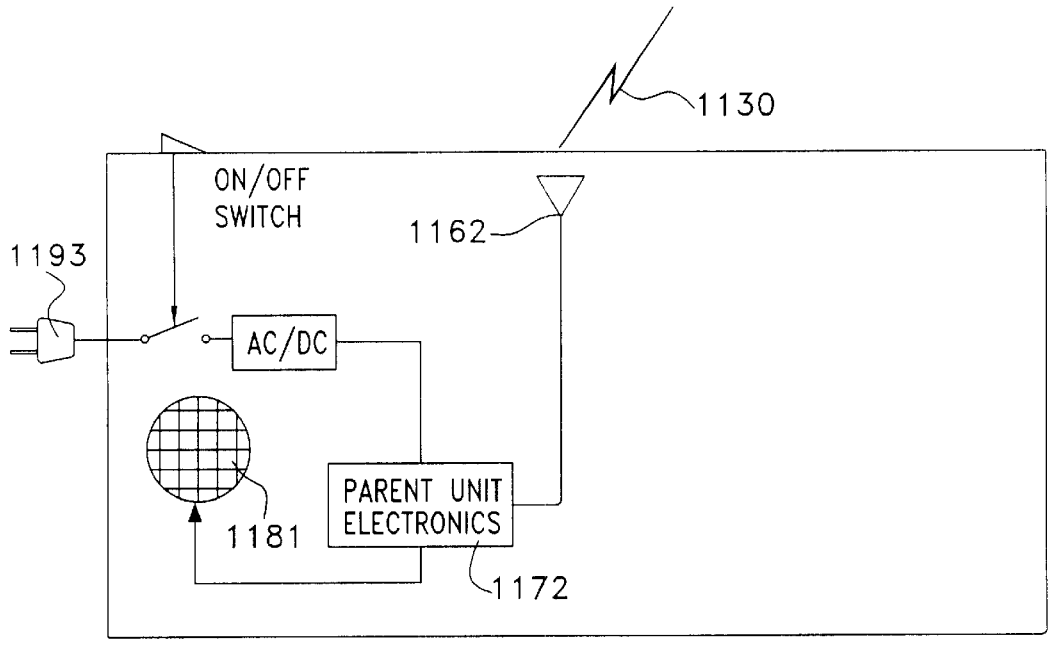
FIG. 5C is a block diagram/schematic of another remotely-located, combined indicator/parent unit that corresponds to the combined gate sensor/baby unit of FIG. 5A.
Figure 6A:
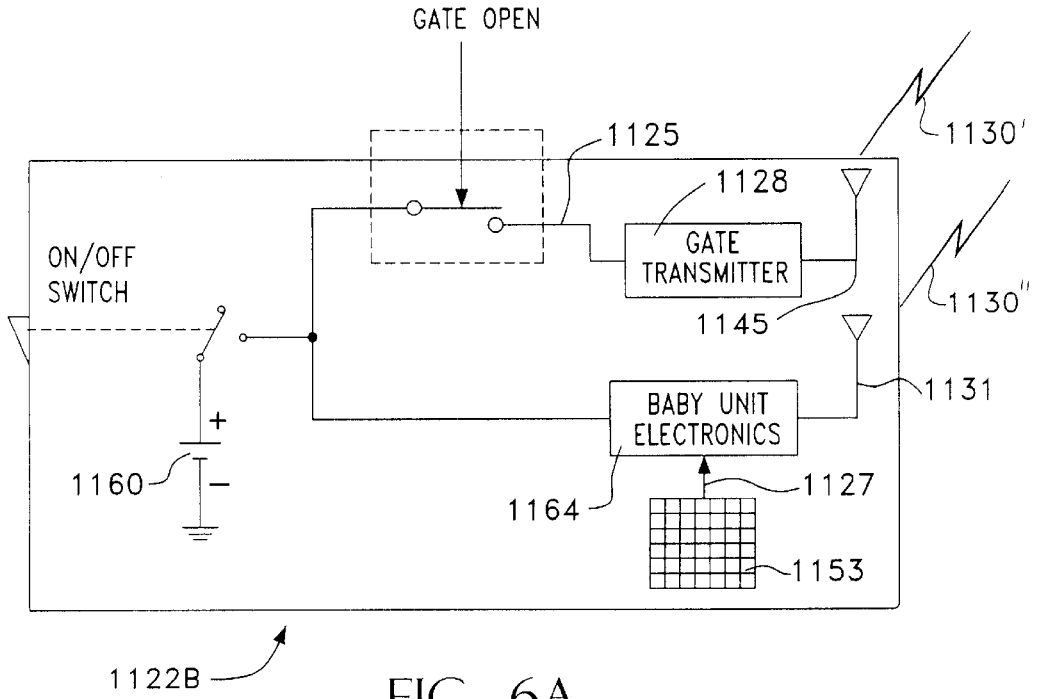
FIG. 6A is a block diagram/schematic of a second embodiment of the combined gate sensor/baby unit.
Figure 6B:
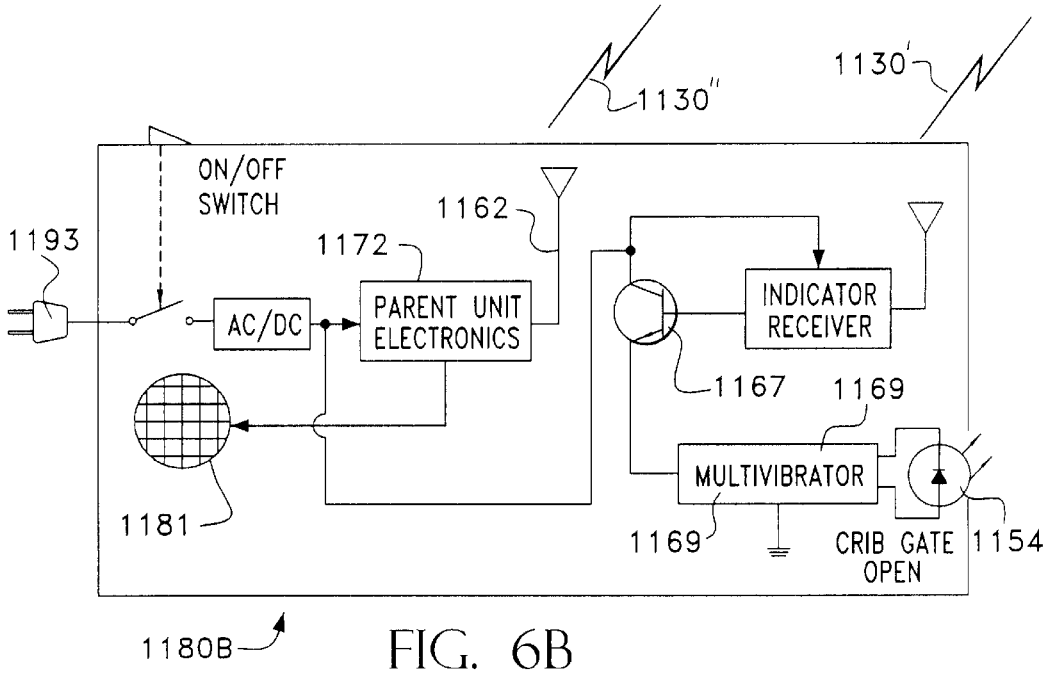
FIG. 6B is a block diagram/schematic of another remotely-located, combined indicator/parent unit that corresponds to the combined gate sensor/baby unit of FIG. 5B.

The present application discloses a first embodiment of the crib gate position indicator 1120 that comprises the combined gate sensor/baby unit 1122A in FIG. 5A as well as a corresponding combined indicator/parent unit 1180A in FIG. 5B, or an alternative combined indicator/parent unit 2180A (FIG. 5C). The present application also discloses a second embodiment of the crib gate position indicator that comprises the combined gate sensor/baby unit 1122B shown in FIG. 6A as well as a corresponding combined indicator/parent unit 1180B in FIG. 6B. Generally, in the first embodiment, the combined gate sensor/baby unit 1122A generates a signal 1125 representative of the open condition of the crib gate 26 that is combined with the conventional baby unit signal 1127 (i.e., the baby sounds, baby room environment, etc.) to form the signal 1130 that is wirelessly transmitted and received by the combined indicator/parent unit 1180A which then demodulates the signal 1130 into the signal 1125 (if present in the signal 1130) that drives the indicator 1154 (e.g., a visual indicator) and the conventional baby unit signal 1127 that drives the speaker 1181; alternatively, the alternate combined indicator/parent unit 2180A can be used where the signal 1130 is played out through the speaker 1181 so that both the baby unit signal 1127 and the crib gate open signal 1125 are heard together; the presence of the crib gate open signal 1125 causes an audible variation (e.g., hum or loud static over the baby sounds) in the baby sound signal that can be heard by a parent or caregiver to alert that person that the crib gate 26 is open. In contrast, in the second embodiment, the signal 1130 actually comprises two independent signals 1130' and 1130" which correspond to the crib gate open signal 1125 and the conventional baby unit signal 1127, respectively.

As mentioned earlier, the combined gate sensor/baby units 1122A and 1122B comprise the crib gate switch 1152 (e.g., a C&K®8168J81ZGE22 SPDT switch or proximity switch) that is located, for example, on a top surface of the housing 1150. It should be understood that the switch 1152 is by way of example only and that any similar or equivalent means for detecting the open position of the gate 26 (e.g., a proximity switch, a magnetically-coupled sensor, Hall effect sensor, etc. such as those shown in U.S. Pat. Nos. 4,278,968 (Arnett et al.); 5,365,214 (Angott et al.); 5,499,014 (Greenwaldt); and 5,689,236 (Kister), all of whose disclosures are incorporated by reference herein). As a result, even the location of the switch 1152, in the top surface of the housing 1150, is by way of example only and is not limited in any way to that location. The important feature is that the switch 1152 detects the open position of the crib gate 26 and provides the crib gate open signal 1125 for further processing by the combined gate sensor/baby unit 1122. As a result, the phrase "interfaced with the crib gate 26" generally describes these various ways of detecting the open position of the crib gate 26.

With particular respect to the first embodiment, i.e., the combined gate sensor/baby unit 1122A and combined indicator/parent unit 1180A, the combined gate sensor/baby unit 1122A operates as a follows: When the crib gate switch 1152 is depressed (or otherwise detects the approach of ) the lower molding 32B of the crib gate 26, power is provided from an internal power source 1160 (e.g., a 9VDC battery, a lithium battery, etc., or any equivalent power source) to a signal generator 1161 (e.g., a square wave, a triangle wave, or even just a DC bias from the power source 1160 itself, etc.). This signal generator 1161 generates the crib gate open signal 1125 that is passed to the conventional baby unit electronics 1164, which includes a modulation means (not shown). As a result, the crib gate open signal 1125 is modulated along with the conventional baby sound signal 1127 from the microphone 1153 into the resultant wireless signal 1130 from an internal antenna 1131. It should be understood that where the crib gate 26 is left in a closed position and the switch 1152 is not otherwise detecting an open condition, there is no crib gate open signal 1125 generated and the only signal being carried by the wireless signal 1130 is the conventional baby sound signal 1127.

Upon receipt of the wireless signal 1130 by a receiver antenna 1162, the signal 1130 is monitored by a detector 1163 for the crib gate open signal 1125. If the crib gate open signal 1125 is present in the signal 1130, the detector 1163 turns on a transistor 1167 that activates a mulitvibrator 1169 which drives the indicator 1154 (FIG. 5B, e.g., a light emitting diode-Panasonic LN28RP, a light bulb or any type of illuminator, causing it to flash), thereby warning the parent or caregiver in view of the remotely-located indicator 1180A to go to the crib 22 and close the gate 26. Once the gate 26 is closed, the switch 1152 is opened and there no longer is a crib gate open signal 1125 generated. Furthermore, the signal 1130 is then filtered by a filter 1170 to remove the crib gate open signal 1125, if present. The signal emerging from the filter 1170 contains the conventional baby sound signal 1127 which is passed to the parent electronics 1172 where it is demodulated and then played out by the speaker 1181.

The modulation means in the baby unit electronics 1164 in the combined gate sensor/baby unit 1122A can be any conventional modulation means used in the wireless transmission of a typical baby monitor signal with the added ability to further modulate the carrier signal (e.g., 900 MHZ, 2.4 GHz, etc., where low power, wireless transmission is permitted for home use) with the signal 1130 when present. Similarly, the demodulating means used in the parent unit electronics 1172 in the combined indicator/parent unit 1180A can be any conventional demodulation means used in the reception of a wirelessly transmitted baby monitor signal for demodulating the received signal 1130 into the baby sound signal 1127.

An alternative combined indicator/parent unit 2180A is shown in FIG. 5C. In this alternative embodiment, the parent unit electronics 1172 deliver the signal 1130, including the embedded signal 1125 (if present) to the speaker 1181. The result played out by the speaker 1181 is the sounds of the baby, or baby room environment with an audible variation (e.g., hum, or loud static over the baby sounds or baby room environment, or other irritating or distorting sounds) that can be clearly detected by the parent or caregiver, thereby alerting that person that the crib gate 26 is in an open condition. Once corrective action is taken (i.e., the crib gate 26 is closed), the crib gate open signal 1125 disappears and the audible variation terminates. As a result, the baby sounds/baby environment sounds can then be heard clearly.

It should be understood that although an on/off switch is shown for the combined gate sensor/baby unit 1122A to conserve battery power, it is within the broadest scope of the invention to omit such a switch such that the combined gate sensor/baby unit 1122A is always enabled. In either case, the combined gate sensor/baby unit 1122A may include a battery level indicator, e.g., an LED, (not shown) that illuminates or flickers/flashes to indicate low battery level.

With particular respect to the second embodiment, i.e., the combined gate sensor/baby unit 1122B and combined indicator/parent unit 1180B, the combined gate sensor/baby unit 1122B operates as a follows: When the crib gate switch 1152 is depressed (or otherwise detects the approach of ) the lower molding 32B of the crib gate 26, power is provided from an internal power source 1160 (e.g., a 9VDC battery, a lithium battery, etc., or any equivalent power source) to a gate transmitter 1128 (e.g., Linear Alert Receiver Model No. D-8C and associated transmitter), thereby activating the gate transmitter 1128 to emit a "crib gate open" signal 1130' from an antenna 1145 toward the remotely-located, combined indicator/parent unit 1180B. Simultaneously, the baby unit electronics 1164 emits the conventional baby sound signal 1127 as the wireless signal 1130" also towards the remotely-located, combined indicator/parent unit 1180B via the antenna 1131.

The wireless signal 1130' is received by an indicator receiver 1173 (e.g., Linear Alert Receiver Model No. D-8C) via an antenna 1159 and the wireless signal 1130" is received by the parent unit electronics 1172 via the antenna 1162. The respective signals 1130' and 1130" are processed as follows: if signal 1130' is received, the indicator receiver 1173 1 turns on the transistor 1167 that activates the mulitvibrator 1169 which drives the indicator 1154 (a visual indicator such as an LED, causing it to flash), thereby warning the parent or caregiver in view of the remotely-located indicator 1180B to go to the crib 22 and close the gate 26. Once the gate 26 is closed, the switch 1052 is opened and there no longer is a crib gate open signal 1125 generated. Simultaneously, the signal 1130" is passed to the parent electronics 1172 where it is demodulated and then played out by the speaker 1181. The remotely-located, combined indicator/parent unit 1180B comprises a visual indicator 1154 (FIG. 6B, e.g., a light emitting diode-Panasonic LN28RP, a light bulb or any type of illuminator).

As with the first embodiment, the baby unit electronics 1164 and the parent unit electronics 1172 of the second embodiment operate as conventional baby monitoring system electronics (e.g., 900 MHz, 2.4 GHz, etc., where low power, wireless transmission is permitted for home use; similar modulation and demodulation mechanisms, etc.).

It is contemplated by Applicants that the gate transmitter 1128/indicator receiver 1173 include logic for appending additional changeable coded information on the signal 1130' sent between them which can be employed to prevent interference between the use of the present invention 1120 and the baby monitor signal 1130" or other wireless devices (e.g., garage door openers, window alarms, etc.) in the area which might be affected thereby.

It should be understood that although an on/off switch is shown for the combined gate sensor/baby unit 1122B to conserve battery power, it is within the broadest scope of the invention to omit such a switch such that the combined gate sensor/baby unit 1122A is always enabled. In either case, the combined gate sensor/baby unit 1122A may include a battery level indicator, e.g., an LED, (not shown) that illuminates or flickers/flashes to indicate low battery level.

Figure 7A:
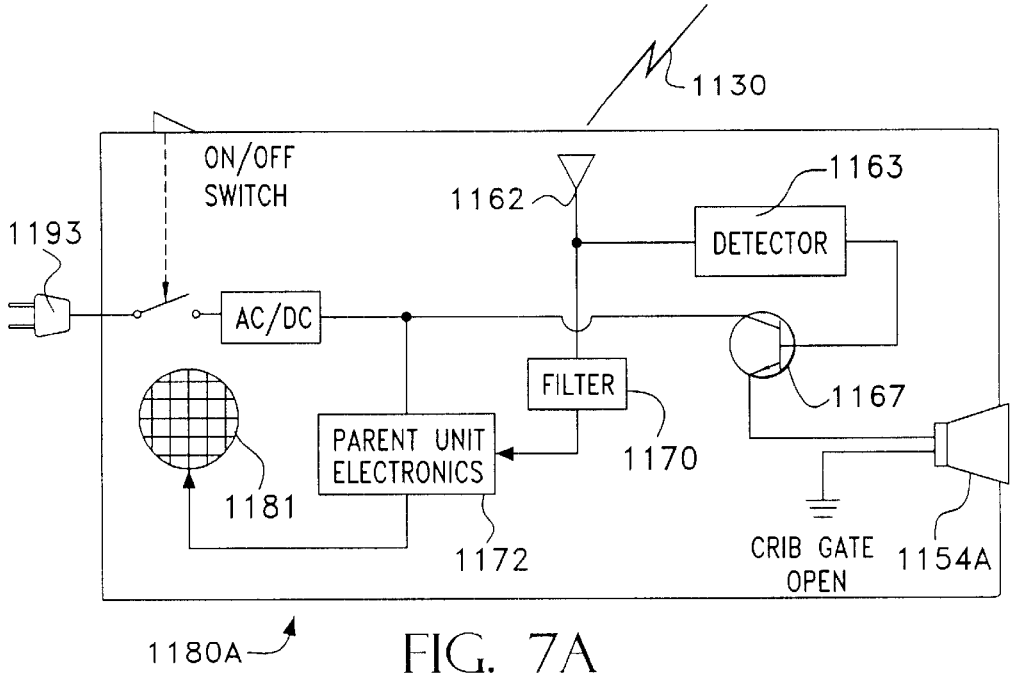
FIGS. 7A–7B are block diagrams of the remotely-located, combined indicator/parent units utilizing an audible indicator.
Figure 7B:
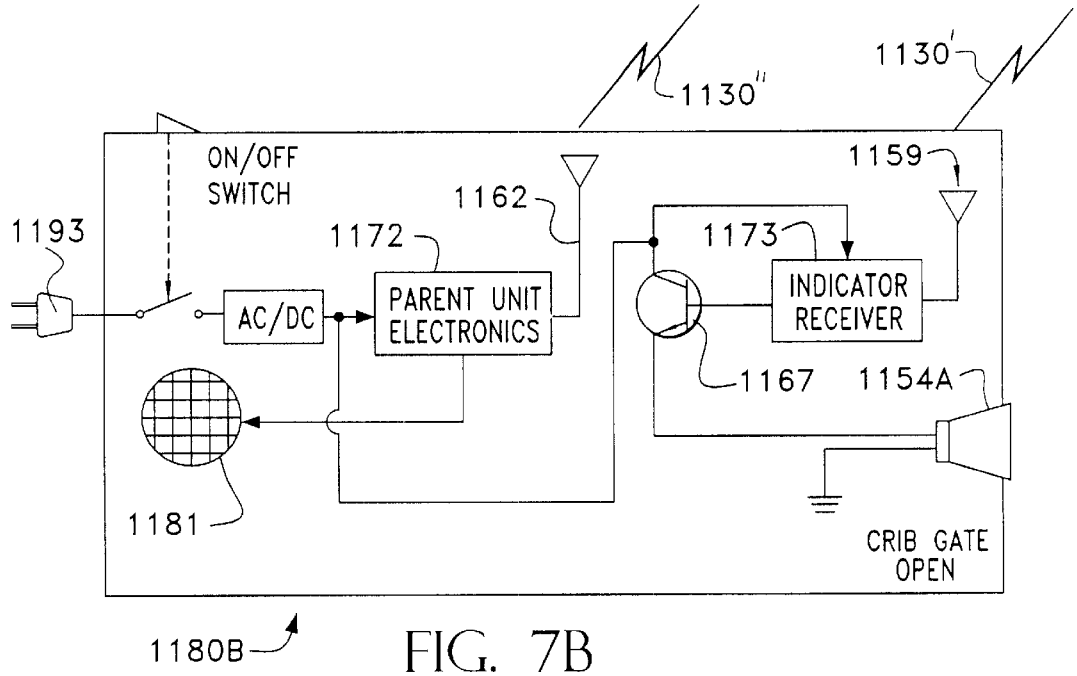

It should also be understood that although the indicator 1154 depicted in the combined indicator/parent units 1180A/1180B is a visual indicator (e.g., LED), this visual indicator could be replaced with an audible indicator or annunciator 1154A (FIG. 7A for the combined indicator/parent unit 1180A and FIG. 7B for the combined indicator/parent unit 1180B), e.g., Panasonic EFB-CB37C11 Ceramic Buzzer, which provides an audible warning. The audible indicator 1154A may even provide a more distinct sound/alarm to the parent or caregiver than the audible variation that emanates from the speaker 1181 in the combined indicator/parent unit 2180C (FIG. 5C). For example, if the audible indicator 1054A is used, the turning on of the transistor 1167 causes the audible indicator 1054A to emit an audible signal (e.g. a humming, a whistle, a statement, a tune, etc.) that can be heard by the parent or caregiver causing them to take corrective action, i.e., close the crib gate 26. It should be understood that the multivibrator 1169 could be coupled between the transistor 1167 and the audible indicator 1154A to cause a wavering sound for the audible signal.

Although not shown, the bottom surface of the housing 1150 (FIG. 2) of the combined gate sensor/baby unit 1122 may include a fastening means (e.g., Velcro fastening tape, magnet, screw, clasp, etc. or any other equivalent securing means) for securing the combined gate sensor/baby unit to one of the crib support plates 34B or 36B. It should be understood that such fastening means are by way of example only and are not limited to those shown but include any manner known in the art of securing the housing 1150 to the crib 22 such that the switch 1152 is capable of detecting the opened condition of the gate 26 when so positioned.

Furthermore, it should be understood that, although not is, shown, it is within the broadest scope of the invention to include the combined gate sensor/baby unit 1122 that is integral with the crib 22, i.e., the combined gate sensor/baby unit 1122 can either be coupled to an existing crib 22, as discussed above, or can be integral with the crib 22 frame.

The remotely-located, combined indicator/parent units 1180A, 1180B, 2180A further comprises a conventional plug 1193 that permits these combined indicator/parent units 1180A, 1180B, 2180A to be plugged into any electrical wall outlet (not shown) throughout the home. However, it is within the broadest scope of this invention to include a remotely-located, combined indicator/parent unit 1180A, 1180B and 2180A that is also battery-operated.

Figure 8A:
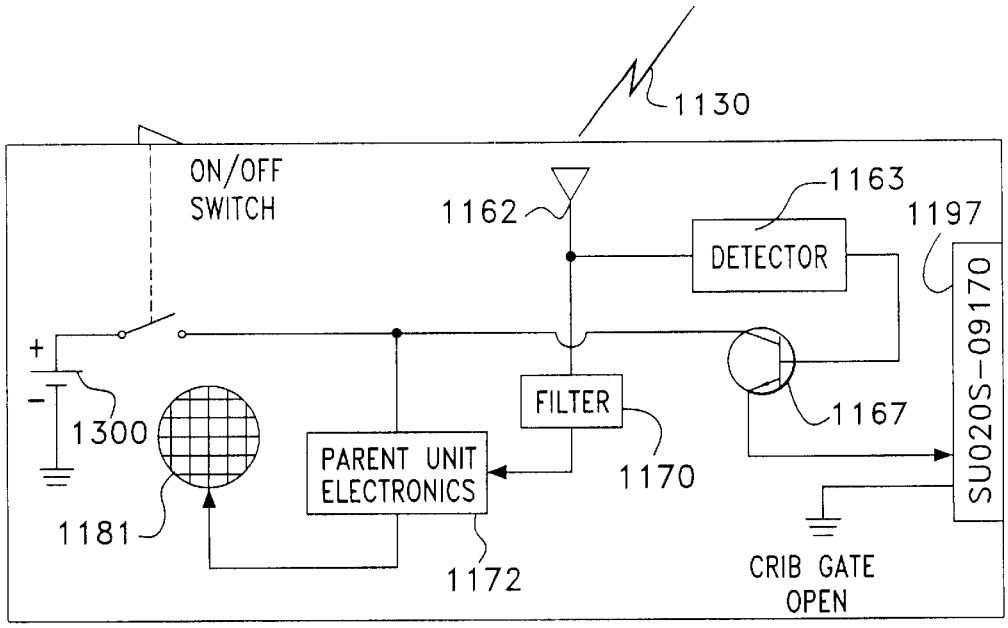
FIG. 8A depicts a portable, combined indicator/parent unit using a tactile sensor.
Figure 8B:
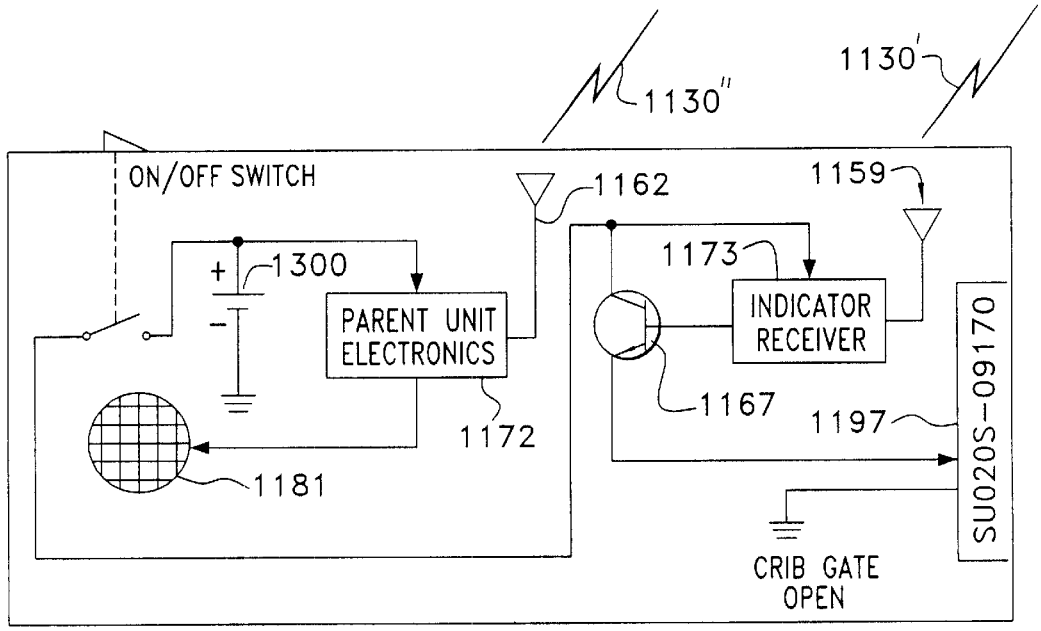
FIG. 8B depicts another portable, combined indicator/parent unit using a tactile sensor.

The remotely-located, combined indicator/parent unit 1180A or 1180B may also comprise a portable unit, comprising its own power source 1300 (e.g., a 9VDC battery, a lithium battery, etc., or any equivalent power source), with the transistor 1167 driving a tactile indicator 1197 (e.g., SU 020S-09170 vibrator device), as shown in FIGS. 8A and 8B. Thus, when the indicator receiver 1173 receives the emitted signal 1130 or 1130' , the receiver 1173 turns on the transistor 1067 which activates the tactile indicator 1197 which is felt by the parent or caregiver who is wearing (e.g., on the wrist or waist, see FIG. 8C) the portable remotely-located, combined indicator/parent unit 1180A or 1180B.

Figure 9:
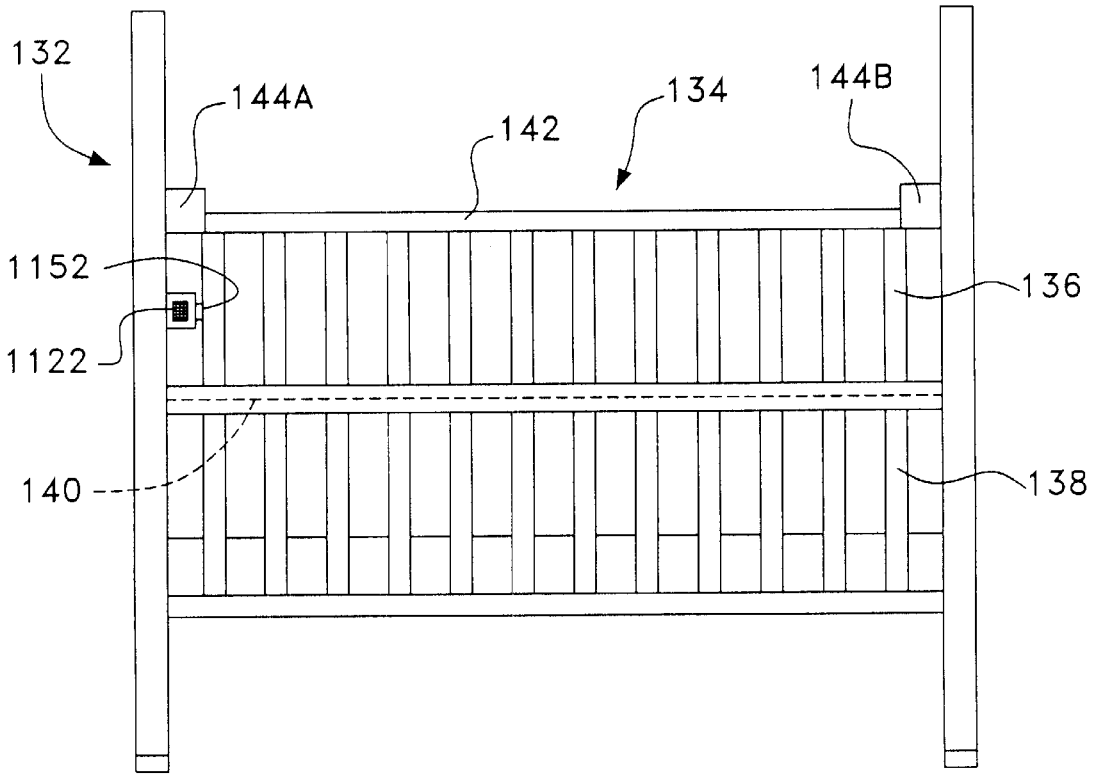
FIG. 9 is a side view of another conventional crib having a rotating gate and having a combined gate sensor/baby unit coupled thereto.

It should be noted that is also within the broadest aspect of this invention to have the combined gate sensor/baby unit 1122A and 1122B be compatible with a variety of displaceable gate cribs. For example, there is shown in FIG. 9, a Gerry Wood Products, Inc. Model 85 crib 132 having a crib gate 134 that has-a rotatable upper portion 136 and fixed lower portion 138. In particular, the upper portion 136 rotates about an axis 140 towards the crib interior (into the plane of the paper in FIG. 9), thereby opening the gate 134. The ends of the upper molding 142 are releasably press-fit into catches 144A and 144B by the parent or infant-caretaker to close the gate 134. Pressure on the upper molding 142 towards the crib interior disengages the ends of the upper molding 142 from the catches 144A and 144B, thereby opening the gate 134. FIG. 9 depicts the crib gate 134 in a closed condition.

The gate sensor 1152 can be coupled to the crib 132 to detect the "open" condition of the upper portion 136. To operate properly, though, the switch 1152 would be reversed, i.e., the switch 1152 depicted in FIGS. 5A/6A would be open (i.e., the power source 1160 and the signal generator 1161 (or the gate transmitter 1128) would be de-coupled) whenever the upper portion 136 were closed; conversely, when the upper portion 136 were open, the switch 1152 would be closed, thereby coupling the power source 1160 to the signal generator 1161, or to the gate transmitter 1128, to emit the signal 1130 or 1130' , respectively.

It should be further understood that it is within the broadest scope of the invention to include a digital implementation of both the combined gate sensor/baby unit 1122 and the combined indicator/parent unit 1180 and that the analog implementation is exemplary only.

Figure 14:
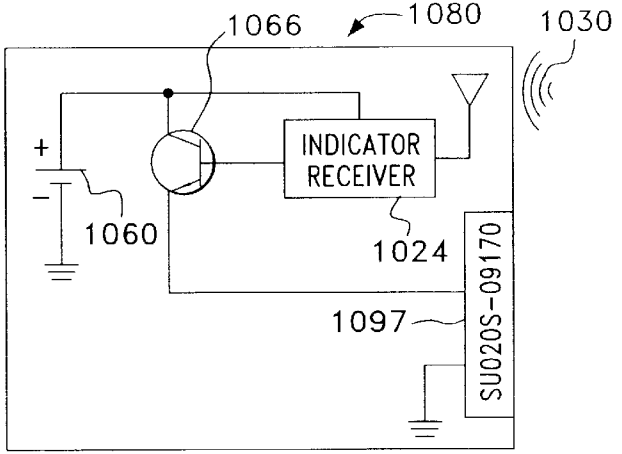
FIG. 14 is a portable, battery-operated, remotely-located indicator of application Ser. No. 09/383,176 which uses a tactile indicator.
Figure 13:
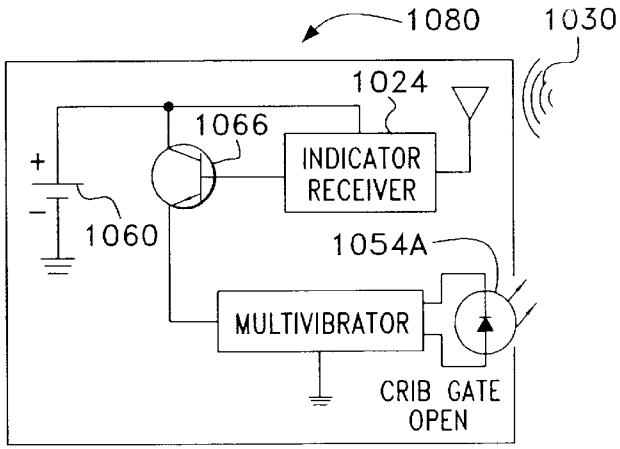
FIG. 13 is a schematic of the battery-operated, remotely-located indicator of application Ser. No. 09/383,176.
Figure 8C:
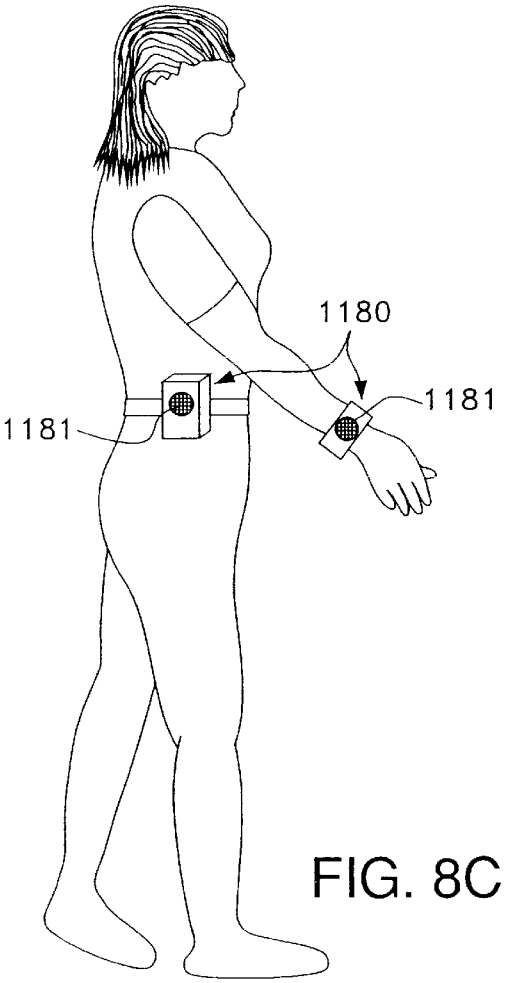
FIG. 8C depicts the portable, combined indicator/parent unit being worn by a parent or caregiver.
Figure 10:
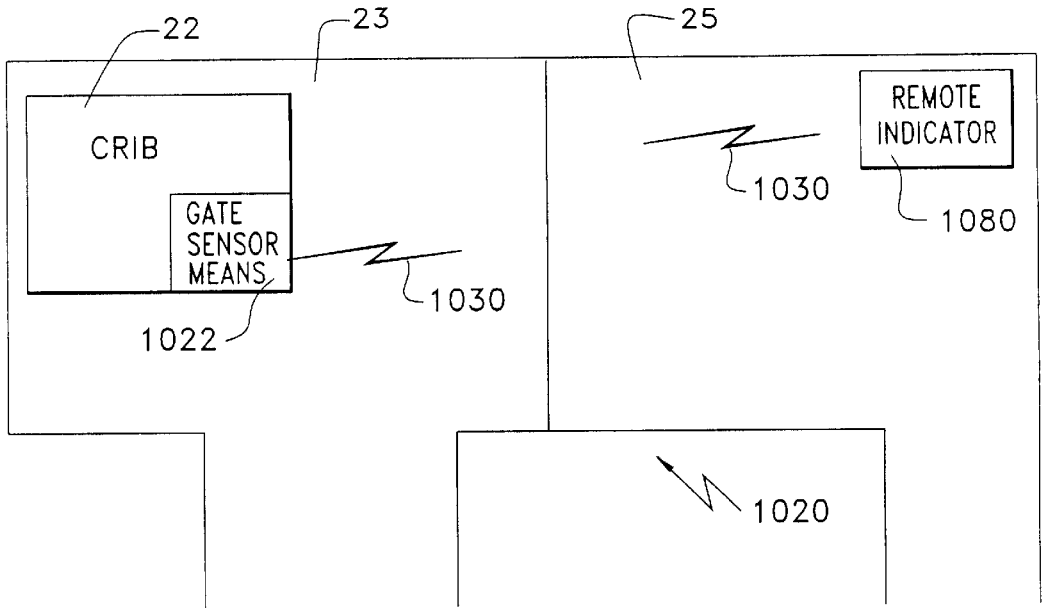
FIG. 10 is a top plan view of a home showing the crib gate position indicator of application Ser. No. 09/383,176.
Figure 11:
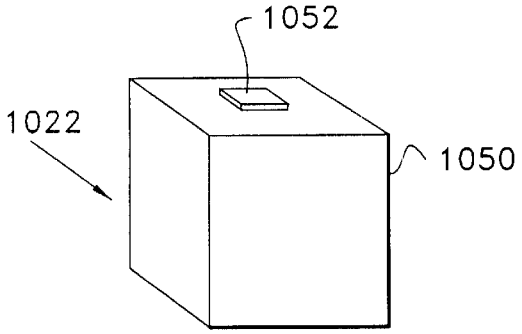
FIG. 11 is an isometric view of the gate sensor of the crib gate position indicator of application Ser. No. 09/383,176.
Figure 12:
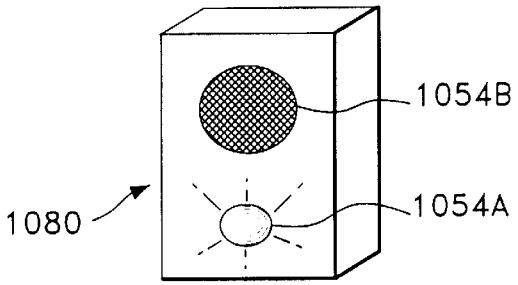
FIG. 12 is an isometric view of a battery-operated, remotely-located indicator of the crib gate position indicator of application Ser. No. 09/383,176 and showing either a visual indicator or an audible indicator.

FIGS. 10–12 depict the crib gate position indicator 1020 of application Ser. No. 09/383,176 except that the remotely-located indicator 1080 (FIG. 13) is battery-operated. The crib gate position indicator 1020 of application Ser. No. 09/383,176 does not involve a baby monitoring system. In light of this, as shown in FIG. 14, the visual indicator 1054A or the audible indicator 1054B have been replaced with the tactile indicator 1197 (e.g., SU 020S-09170 vibrator it device) and the parent unit 1080 can be portable. As a result, the portable parent unit 1080 can be worn by the user (e.g., on the wrist or waist, as shown in FIG. 8C).

Furthermore, it should be understood that the switch 1052 of the gate sensor 1022 disclosed in application Ser. No. 09/383,176 operates similarly to the switch 1152 of the gate sensor 1122 of the present invention, as described earlier. As a result, the phrase "interfaced with the crib gate 26" generally describes all of the different ways of detecting the open position of the crib gate 26 by the gate sensor 1022.

Without further elaboration, the foregoing will so fully illustrate our invention that others may, by applying current or future knowledge, readily adopt the same for use under various conditions of service.

We claim:

1. An apparatus for providing an automatic crib gate position indication of a crib having a gate that can be positioned in an open or a closed condition, said apparatus comprising:

a non-intrusive unit that is positioned out of reach of an infant or toddler who is placed in the crib, said non-intrusive unit comprising:

a first power source;

a microphone and transmitter, coupled to said power source, for detecting the sounds of the infant or toddler placed in the crib and for generating a wireless signal representative of the sounds;

a switch interfaced with the gate and electrically coupled to a signal generator, said switch electrically coupling said signal generator to said power source whenever the gate is in an open condition to form a crib gate open condition signal;

said signal generator having an output coupled to said transmitter for incorporating said crib gate open condition signal into said wireless signal;

a remotely-located unit, being coupled to a second power source, said remotely-located unit comprising:

a receiver, electrically coupled to the second power source, for receiving said wireless signal;

a speaker, electrically coupled to said receiver, said speaker playing out the sounds of the infant or toddler in accordance with said received wireless signal; and an indicator electrically coupled to said receiver, said indicator being active whenever said crib gate open condition signal is present in said wireless signal, said active indicator alerting someone in the vicinity of said remotely-located unit that the crib gate is in an open condition.

2. The apparatus of claim 1 wherein said indicator is an illuminator.

3. The apparatus of claim 1 wherein said indicator is an annunciator.

4. The apparatus of claim 1 wherein said second power source is a battery and wherein said remotely-located unit is wearable against the body of a caretaker, said indicator comprising a tactile sensor that provides a tactile indication to the caretaker wearing said remotely-located unit that the crib gate is in an open condition.

5. The apparatus of claim 1 wherein said receiver comprises a detector coupled to said indicator wherein said detector detects the presence of the crib gate open condition signal for activating said indicator.

6. The apparatus of claim 5 wherein said receiver further comprises a filter for removing said crib gate open condition signal from said received wireless signal before it reaches said speaker.

7. An apparatus for providing an automatic crib gate position indication of a crib having a gate that can be positioned in an open or a closed condition, said apparatus comprising:

a non-intrusive unit that is positioned out of reach of an infant or toddler who is placed in the crib, said non-intrusive unit comprising:

a first power source;

a microphone and transmitter, coupled to said power source, for detecting the sounds of the infant or toddler placed in the crib and for generating a wireless signal representative of the sounds;

a switch interfaced with the gate and electrically coupled to a signal generator, said switch electrically coupling said signal generator to said power source whenever the gate is in an open condition to form a crib gate open condition signal;

said signal generator having an output coupled to said transmitter for incorporating said crib gate open condition signal into said wireless signal;

a remotely-located unit, being coupled to a second power source, said remotely-located unit comprising:

a receiver, electrically coupled to the second power source, for receiving said wireless signal;

a speaker, electrically coupled to said receiver, said speaker playing out the sounds of the infant or toddler along with any audible variation caused by the presence of crib gate open condition signal in said received wireless signal, said audible variation alerting someone in the vicinity of said remotely-located unit that the crib gate is in an open condition.

8. The apparatus of claim 7 wherein said audible variation comprises a hum or noise on top of the sounds of the infant or toddler.

9. An apparatus for providing an automatic crib gate position indication of a crib having a gate that can be positioned in an open or a closed condition, said apparatus comprising:

a non-intrusive unit that is positioned out of reach of an infant or toddler who is placed in the crib, said non-intrusive unit comprising:

a first power source;

a microphone and transmitter, coupled to said power source, for detecting the sounds of the infant or toddler placed in the crib and for generating a first wireless signal representative of the sounds;

a switch interfaced with the gate and electrically coupled to a second transmitter, said switch electrically coupling said second transmitter to said power source whenever the gate is in an open condition to form a second wireless signal representative of the open condition of the crib gate;

a remotely-located unit, being coupled to a second power source, said remotely-located unit comprising:

a first receiver, electrically coupled to the second power source, for receiving said first wireless signal;

a speaker, electrically coupled to said first receiver, said speaker playing out the sounds of the infant or toddler in accordance with said received first wireless signal; and an indicator electrically coupled to a second receiver, said indicator being active whenever said second wireless signal is received by said second receiver, said active indicator alerting someone in the vicinity of said remotely-located unit that the crib gate is in an open condition.

10. The apparatus of claim 9 wherein said indicator is an illuminator.

11. The apparatus of claim 9 wherein said indicator is an annunciator.

12. The apparatus of claim 9 wherein said second power source is a battery and wherein said remotely-located unit is wearable against the body of a caretaker, said indicator comprising a tactile sensor that provides a tactile indication to the caretaker wearing said remotely-located unit that the crib gate is in an open condition.

13. An apparatus for providing an automatic crib gate position indication of a crib having a gate that can be positioned in an open or a closed condition, said apparatus comprising:

a non-intrusive gate sensor that is positioned out of reach of an infant or toddler who is placed in the crib, said gate sensor comprising:

a power source;

a transmitter for wirelessly transmitting a signal when electrically coupled to said power source; and a switch interfaced with the gate and electrically coupling said power source to said transmitter whenever the gate is in an open condition; and a remotely-located indicator comprising a receiver and an indicator, said receiver receiving said signal and activating said indicator to alert someone in the vicinity of said remotely-located indicator that the crib gate is in an open condition.

14. The apparatus of claim 13 wherein said indicator is a tactile indicator that is worn by a person.

15. The apparatus of claim 13 wherein said indicator is a visual indicator.

16. The apparatus of claim 13 wherein said indicator is an audible indicator.

17. The apparatus of claim 13 wherein said switch comprises a non-contact sensor that detects the open condition of the gate and electrically couples said power source to said transmitter.

18. The apparatus of claim 13 wherein said remotely-located indicator further comprises AC/DC conversion circuitry and electrical plug for insertion into a conventional electrical wall outlet.

19. An apparatus for providing an automatic crib gate position indication of a crib having a gate that can be positioned in an open or a closed condition, said apparatus comprising:

a non-intrusive gate sensor that is positioned out of reach of an infant or toddler who is placed in the crib, said gate sensor comprising:

a power source;

a transmitter for wirelessly transmitting a signal when electrically coupled to said power source; and a switch coupled to the crib and electrically coupling said power source to said transmitter whenever the gate is in an open condition; and a remotely-located indicator comprising a receiver and an indicator, said receiver receiving said signal and activating said indicator to alert someone in the vicinity of said remotely-located indicator that the crib gate is in an open condition.

20. The apparatus of claim 19 wherein said indicator is a visual indicator.

21. The apparatus of claim 19 wherein said indicator is an audible indicator.

22. The apparatus of claim 19 wherein said switch comprises a non-contact sensor that detects the open condition of the gate and electrically couples said power source to said transmitter.

23. The apparatus of claim 19 wherein said remotely-located indicator further comprises AC/DC conversion circuitry and electrical plug for insertion into a conventional electrical wall outlet.

* * * * *